US007771286B2

(12) United States Patent
Campadore et al.

(10) Patent No.: US 7,771,286 B2
(45) Date of Patent: Aug. 10, 2010

(54) PUTTER WITH PIVOTING AIMING ARMS

(75) Inventors: Michael Campadore, Newberg, OR (US); Alan N. O'Kain, West Linn, OR (US)

(73) Assignee: True Putt Enterprises LLC, West Linn, OR (US)

( * ) Notice: Subject to any disclaimer, the term of this patent is extended or adjusted under 35 U.S.C. 154(b) by 0 days.

(21) Appl. No.: 12/135,251

(22) Filed: Jun. 9, 2008

(65) Prior Publication Data

US 2009/0305813 A1 Dec. 10, 2009

(51) Int. Cl.
*A63B 53/06* (2006.01)

(52) U.S. Cl. ..... 473/252; 473/341

(58) Field of Classification Search ..... 473/236, 473/242, 244, 251–253, 268, 340–341, 324, 473/334–336

See application file for complete search history.

(56) References Cited

U.S. PATENT DOCUMENTS

| | | | | |
|---|---|---|---|---|
| 3,698,093 | A | 10/1972 | Marshall | |
| 3,841,640 | A * | 10/1974 | Gaulocher | 473/249 |
| 4,002,343 | A | 1/1977 | Eckert | |
| 4,647,045 | A | 3/1987 | Bilyeu | |
| 4,650,191 | A | 3/1987 | Mills | |
| 4,741,535 | A | 5/1988 | Leonhardt | |
| 5,011,153 | A | 4/1991 | Watkins | |
| 5,308,067 | A * | 5/1994 | Cook | 473/341 |
| 5,810,675 | A | 9/1998 | Weathers | |
| 5,913,730 | A | 6/1999 | Johnson | |
| D458,658 | S | 6/2002 | Jung | |
| 6,878,071 | B1 | 4/2005 | Schwieger | |
| 7,029,404 | B2 * | 4/2006 | Lu | 473/334 |
| 7,247,102 | B2 | 7/2007 | Hayd | |
| 7,326,121 | B2 | 2/2008 | Roake | |
| D604,787 | S | 11/2009 | Hopkins | |
| 7,614,960 | B2 | 11/2009 | Miller et al. | |
| 2006/0030419 | A1 | 2/2006 | Koster | |
| 2006/0030420 | A1 * | 2/2006 | Roake | 473/251 |
| 2007/0066417 | A1 | 3/2007 | Burns | |
| 2007/0238544 | A1 | 10/2007 | Jazwiec | |

FOREIGN PATENT DOCUMENTS

| | | |
|---|---|---|
| JP | 3131377 | 5/2007 |

* cited by examiner

*Primary Examiner*—Stephen L. Blau
(74) *Attorney, Agent, or Firm*—DeLio & Peterson LLC; Peter W. Peterson

(57) ABSTRACT

A golf putter comprising a shaft, a putter head attached along a top surface to the shaft, the head including an elongated body having a central axis along the length of the body. The golf putter includes a pair of aiming arms, each arm pivotally connected at opposing ends of the elongated body and adapted to pivot about the central axis between a forward aiming position and a second position away from the forward aiming position. The golf putter also includes a lever adapted to control rotation of the aiming arms from the forward aiming position to the second position, the lever operable from a portion of the shaft.

11 Claims, 8 Drawing Sheets

PUTTER WITH PIVOTING AIMING ARMS

BACKGROUND OF THE INVENTION

1. Field of the Invention

The present invention relates to a golf putter having pivotable aiming arms which are positionable between a forward aiming position and a rearward aiming position.

2. Description of Related Art

Golf putters having aiming arms for practice putting aid in lining up a golf ball with a golf hole cup. These devices have an aiming pointer attachable to an existing putter head by a clip or temporary fastener. They must take into consideration a variety of factors affecting its attachment to putters of different styles while assuring accurate alignment on the putter. Detachable aiming arms have the convenience of allowing the putter to be used in regulation play, but this feature also allow the aiming arms to be forgotten or misplaced. Examples of such are U.S. Pat. No. 3,698,093 to Marshall, U.S. Pat. No. 4,002,343 to Eckert, U.S. Pat. No. 4,647,045 to Bilyeu and U.S. Pat. No. 5,810,675 to Weathers.

Other practice putters have aiming pointers which are permanently attached. For the putters having a permanently affixed pointer forward of the face, a problem arises in regulation play where no part of the putter head may be forward of the face. Examples of such are U.S. Pat. No. 4,650,191 to Mills and U.S. Pat. No. 7,247,102 to Hayd and U.S. Patent Application Publication No. US2006/0030419. For putting devices having only a rearward positioned pointer, visual alignment of the ball path to the hole is more difficult as seen in U.S. Pat. No. 4,741,535 to Leonhardt and U.S. Pat. No. 7,326,121 to Roake.

Aiming arms allow a golfer to practice putting using aided visual alignment. Aided visual alignment provides the golfer a more precise reference for subsequent putts and will allow the golfer to quickly improve alignment of his putts. However, once the golfer has improved his putting performance, he is often forced to then remove an attachment or switch to a regulation putter during normal play. This often interrupts the golfer's concentration and rhythm.

It would be beneficial for the golfer to have a putter with an aiming device which allows alignment of the ball path to the hole with as much visual accuracy as possible, and which does not interrupt the golfer's flow of play.

SUMMARY OF THE INVENTION

Bearing in mind the problems and deficiencies of the prior art, it is therefore an object of the present invention to provide a golf putter which allows accurate visual alignment of the golf ball to the golf hole or golf cup.

It is another object of the present invention to provide a golf putter which allows aiming arms to be moved from a forward pointing direction to a rearward pointing direction without the golfer having to bend over, lift the putter off the ground, or otherwise interrupt the flow of play.

A further object of the invention is to provide a practice putter which is permitted in regulation play of golf.

It is yet another object of the present invention to provide golf putter aiming arms which provide additional visual alignment aid.

Still other objects and advantages of the invention will in part be obvious and will in part be apparent from the specification.

The above and other objects, which will be apparent to those skilled in the art, are achieved in the present invention which is directed to a golf putter head comprising an elongated body having a central axis along the length of the body and a pair of aiming arms, each arm pivotally connected at opposing ends of the elongated body and adapted to pivot about the central axis between a forward aiming position and a second position away from the forward aiming position.

The golf putter head may include a rotation control mechanism adapted to control rotation of the aiming arms from the forward aiming position to the second position. Additionally, the control mechanism may rotate the aiming arms from the second position to the forward aiming position. The rotational control mechanism may be a lever which impels the pivoting of the aiming arms. The golf putter head may include a drag washer between at least one of the aiming arms and the elongated body wherein the drag washer applies a dampening force on the aiming arm when the aiming arm rotates from the first position to the second position The aiming arms of the golf putter head may have a rotational preload force when the arms are in the aiming position wherein the control mechanism is adapted to release the aiming arms to rotate to the second position.

The golf putter head may include a spring adapted for exerting a rotational force on the aiming arms in a direction toward the second position.

The golf putter head may include a top surface of the elongated body adjacent a face surface and the top surface may have a center aiming line.

The aiming arms may have opposite and inward facing arcuate surfaces and the arcuate surfaces correspond to the outline of a golf hole cup wherein the spacing of the pointing arms corresponds to the diameter of a regulation golf hole cup. The aiming arms of the golf putter head may include parallel aiming indicators positioned on the aiming arms wherein the distance between the aiming lines corresponds with the diameter of a regulation golf hole cup.

In another aspect of the present invention a golf putter comprises a shaft and a putter head attached along a top surface to the shaft. The head includes an elongated body having a central axis along the length thereof. The golf putter further includes a pair of aiming arms, each arm pivotally connected at opposing ends of the elongated body and adapted to pivot about the central axis between a forward aiming position and a second position away from the forward aiming position. The golf putter also includes a lever adapted to control rotation of the aiming arms from the forward aiming position to the second position, the lever being operable from a portion of the shaft.

The golf putter may include an axle having ends and an axle groove between the ends positioned along the central axis of the putter body, with the aiming arms being attached at the ends of the axle and a torsion spring being fastened to the putter body and to at least one aiming arm wherein the torsion spring applies a rotational force on the aiming arm. The golf putter may also include a shaft sleeve in the putter head extending downward from the top surface to a shaft sleeve bottom wherein the shaft is slidingly positioned in the shaft sleeve and is in contact with a portion of the axle and a compression spring seated at the bottom of the shaft sleeve, the compression spring urging the shaft in an upward direction. The golf putter may include a shaft slot positioned at the lower end of the shaft in contact with a portion of the axle groove wherein the axle groove engages the shaft, locking the aiming arms in the forward aiming position. Urging the shaft downward disengages the shaft slot from the axle groove, allowing the torsion spring to rotate the aiming arms from the forward aiming position to the second position. The lever may be on an upper portion of the shaft. Alternately, a portion of the shaft is the lever.

In another aspect, the present invention is directed to a method for using a putter with pivoting aiming arms comprising providing a golf putter head having an elongated body having a central axis along a length thereof, a pair of pointing arms, each arm pivotally connected at opposing ends of the elongated body and adapted to pivot about the central axis between a forward aiming position and a second position away from the forward aiming position. The method includes ensuring the aiming arms are in the forward aiming position, approaching a golf ball, lining up a putt and striking the ball toward a golf hole.

The method may additionally include providing a control mechanism adapted to control rotation of the pivoting arms from the forward aiming position to the second position and operating the lever to rotate the aiming arms from the forward aiming position to the second position after lining up the putt and before striking the ball. The control mechanism may also rotate the aiming arms from the forward aiming position to the second position and to rotate the aiming arms from the second position to the forward aiming position. The control mechanism may be a lever.

Alternately, the control mechanism is adapted to rotate the aiming arms from the forward aiming position to the second position and wherein the control mechanism releases the aiming arms from the forward aiming position to the second position.

The method may include providing a drag washer between at least one of the aiming arms and the elongated body wherein the drag washer applies a dampening force on the aiming arm when the aiming arms rotate from the forward aiming position to the second position.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
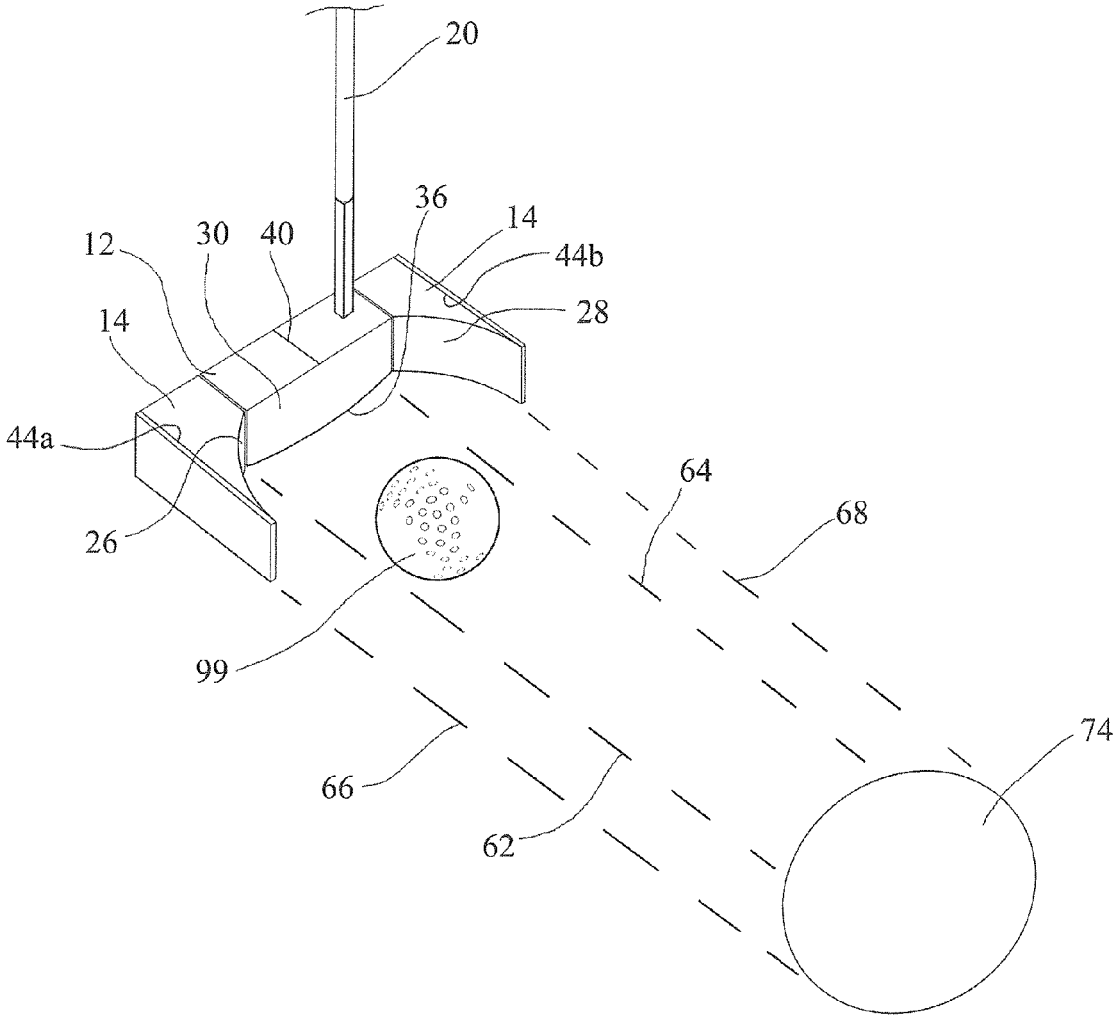
FIG. 1 is a perspective view of the putter head with the pivoting arms in the aiming position in accordance with the present invention.
Figure 2:
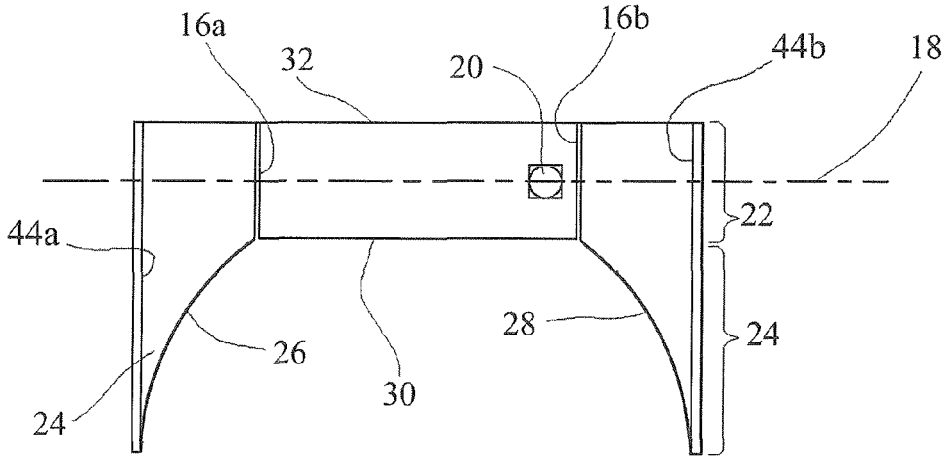
FIG. 2 is a top plan view of the putter of FIG. 1
Figure 3:
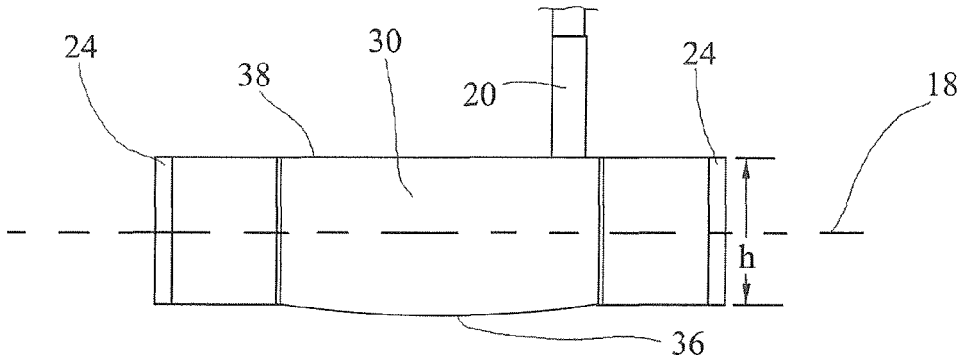
FIG. 3 is a front elevational view of the putter of FIG. 1

In describing the preferred embodiment of the present invention, reference will be made herein to FIGS. 1-11 of the drawings in which like numerals refer to like features of the invention.

FIGS. 1-4 show the preferred putter of the present invention, having a pair of aiming arms in a direction corresponding with the desired direction of the ball. This configuration of the putter head assembly is referred to as the aiming mode. A golf putter head comprises an elongated body 12 having a central axis 18 along the length thereof and a pair of pointing arms 14, each arm pivotally connected at opposing body ends 16*a*, 16*b*. The arms pivot angularly about the central axis between a forward aiming position and a second position away from the forward aiming position. The elongated body and the aiming arms make up the putter head assembly. A shaft 20 is disposed on a top surface 22 of the elongated body.

The elongated body includes a face 30 upon which a golf ball 99 is struck. The face is planar and substantially perpendicular to the ground and to shaft 20, providing the ball 99 with a horizontal force when struck with the face 30. A second surface 32 opposite the face may also be planar and perpendicular to the ground, allowing the putter to be used by a left-handed golfer as well as a right-handed golfer. A bottom surface 36 extends between the face 30 and the second surface 32 opposite the face. A top surface 38 extends between the face and the second surface 32 and preferably includes a center aiming line 40.

Each of the aiming arms 14 preferably has a wide body portion 22 and an outwardly extending pointing member 24. The pointing member has a substantially uniform height h corresponding to the height of the elongated body, and extends from the wide body portion a distance sufficient to allow visual aiming. The aiming arms 14 include aiming indicating lines 44*a*, 44*b* which may be printed or scored, parallel with the outer edge of the aiming arms. The spacing between the aiming lines 44*a*, 44*b* corresponds with the diameter of a regulation golf hole cup. Visual aiming is defined from the perspective of the golfer as he would be positioned directly above the putter head in taking a stroke, visualizing a straight path from the putter to the hole cup 74, lining up the visual lines 66, 68 created by aiming lines 44*a*, 44*b*. The aiming arm includes a respective concave arcuate portion 26, 28 between the pointing member and an area forward the plane of the face 30 as identified when the aiming arms are in a forward aiming position or a forward pointing direction. The arms in the forward aiming position allow the golfer to orient the arcuate portions 26, 28 of the aiming arms with the corresponding regulation diameter of the golf hole cup while lining up his shot using visualization lines 62, 64, 66, 68.

The bottom surface 36 is curved upward toward the body ends so that when the putter head contacts the ground, the center portion of the putter body is in contact with the ground and the body ends are positioned above the ground to allow rotation of the aiming arms.

Figure 5:
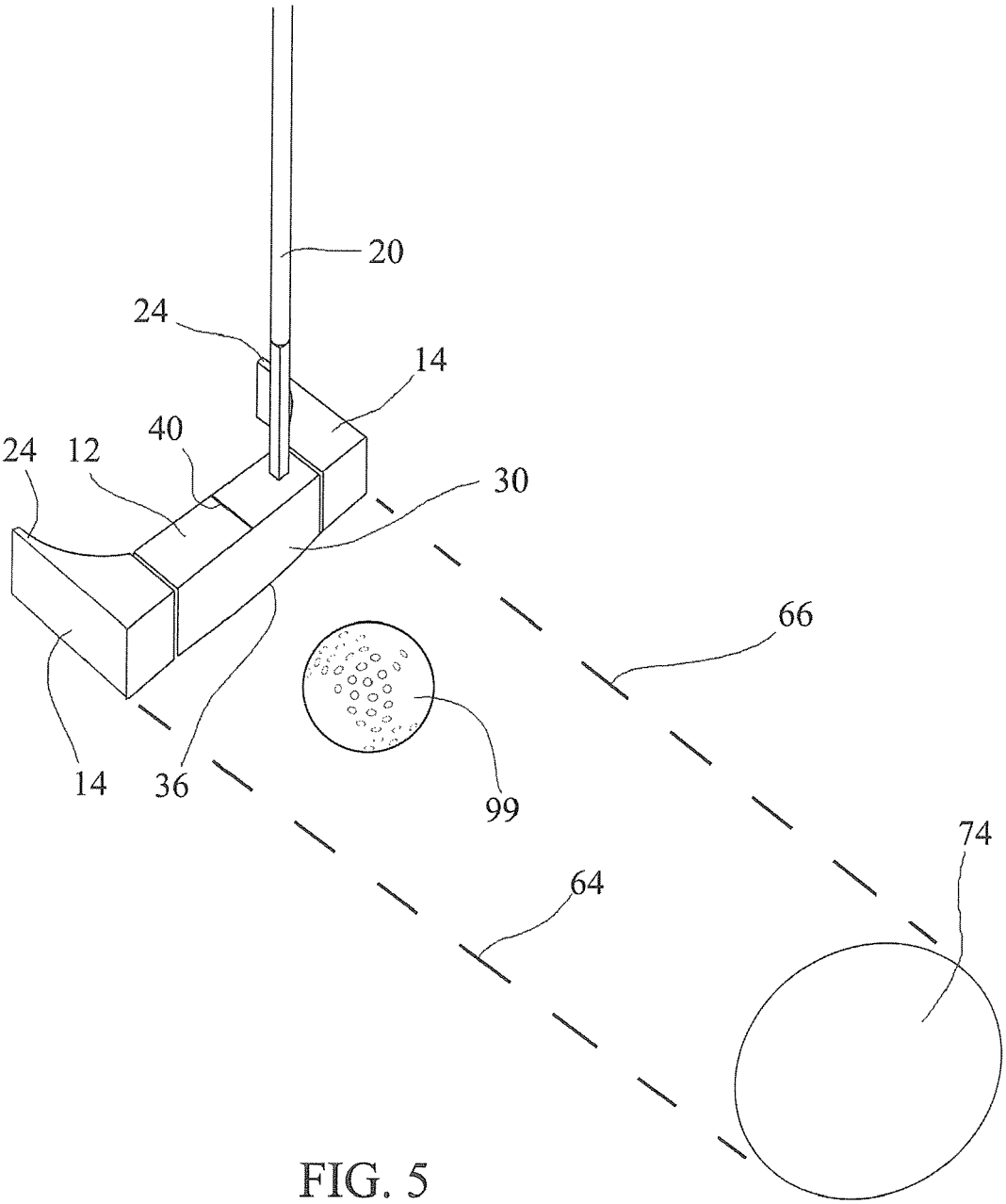
FIG. 5 is a perspective view of the putter of FIG. 1 with its aiming arms rotated away from the aiming position in accordance with the present invention.
Figure 6:
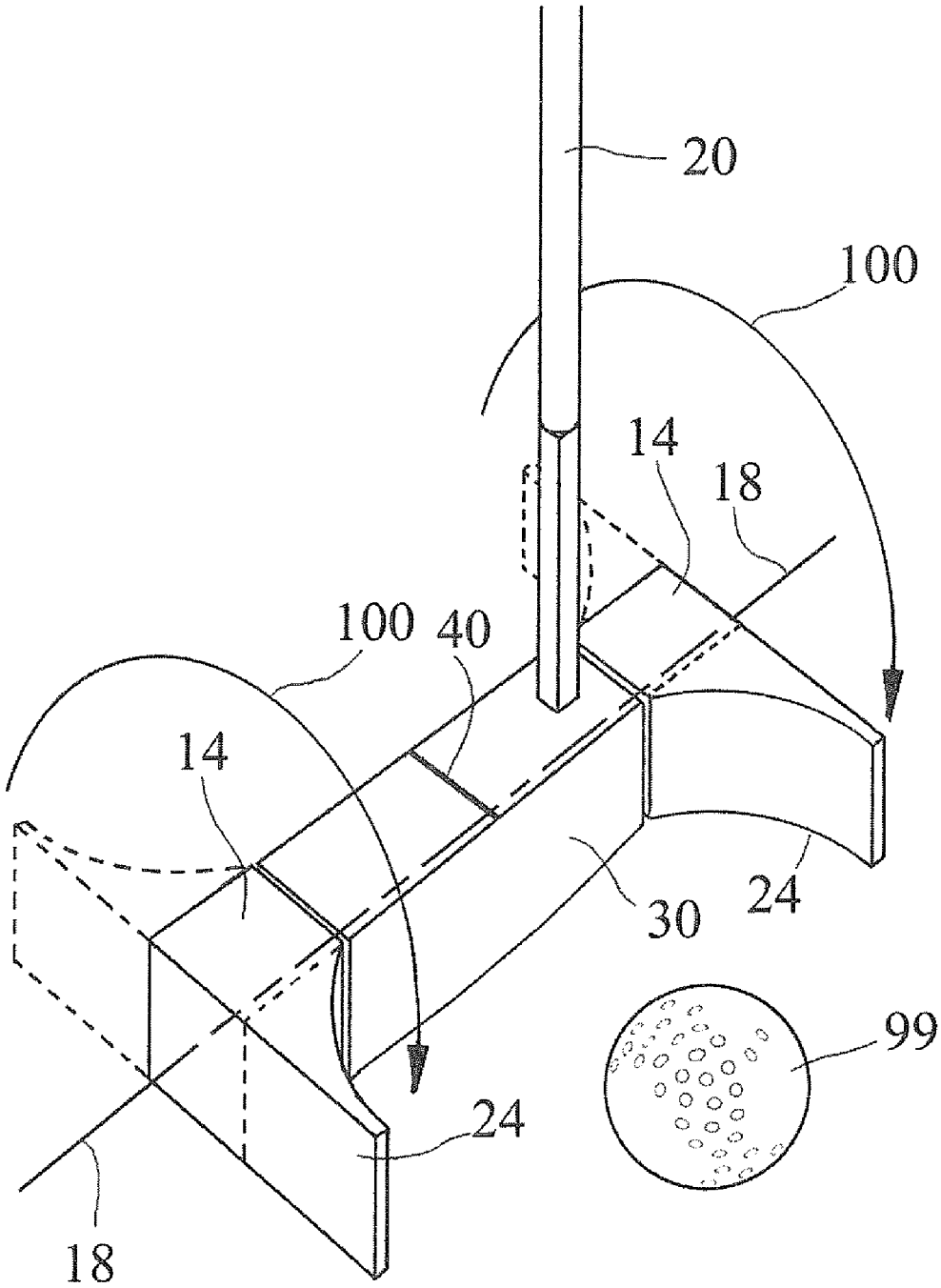
FIG. 6 is a perspective view of the putter of FIG. 1 showing rotation of the aiming arms from the rearward aiming position to the forward aiming position.
Figure 7:
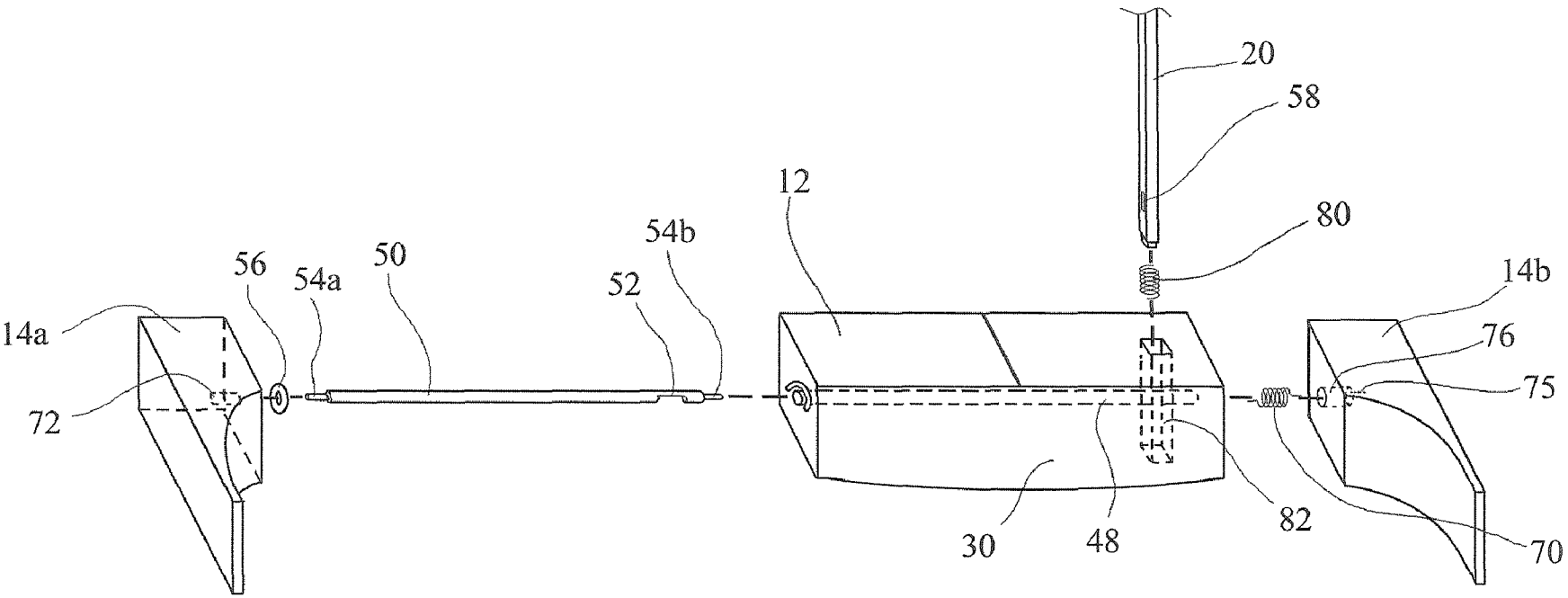
FIG. 7 is an exploded view of the control mechanism allowing rotation of the pivoting aiming arms of the putter in accordance with the present invention.

FIG. 5 shows the aiming arms 14 of the putter rotated away from the forward aiming position and in a rearward pointing direction. With the arms in this rearward aiming position the golfer may line up the putt by visualizing a straight line 64, 66 along the outer edge of the aiming arm. The line extended from this visualized straight line is then lined up with the edge of the cup. The center line 40 engraved into the top of the outer head in a direction perpendicular to the putter face may also be used as an aid in lining up the putt.

The pivoting aiming arms 14 are adapted to pivot about the central axis 18 between a forward aiming position and a second position away from the forward aiming position. This second position may be in an upward facing position. However, in the preferred embodiment of the putter shown in FIG. 6, the second position away from the forward aiming position is the rearward aiming position, also called the rearward pointing direction. Rotational arrows 100 show the rotational movement of the aiming arms as they are re-positioned from the rearward aiming position to the forward aiming position.

The putter preferably also includes a control mechanism comprising a lever adapted to rotate the pivoting arms or to allow their rotation. The lever causes rotation of the pivoting arms from the forward aiming position to a second position, or normal mode, away from the forward aiming position. The lever mechanism may be adapted to pivot the aiming arms between the forward aiming position and the rearward aiming position.

In one embodiment of the control mechanism shown in FIGS. 7-10, the putter includes an axle 50 which connects the pivoting arms 14*a*, 14*b* to one another so they rotate in unison. The axle is generally a smooth and round elongated rod which passes slidingly through an axle sleeve 48 in the putter body 12, the axle ends 54*a*, 54*b* extend outward from the body ends 16*a*, 16*b*, connecting to the aiming arms 14*a*, 14*b* in corresponding aiming arm openings 72, 76. The axle ends may be shaped to allow each end to be slid into the corresponding aiming arm opening 72, 76 where it may be fastened using a set screw tightened through a threaded hole 98 extending from outward of the body to the axle end. The axle ends may alternately be attached to the aiming arms with a snug press fit or adhesive. The axle 50 includes an axle groove 52 between the axle ends positioned in contact with the shaft 20. The lower end of the shaft includes a shaft slot 58 and fits slidingly in a shaft sleeve 82 within the putter body 12. A compression spring 80 seats at the bottom of the shaft sleeve and urges the shaft in an upward direction. Aiming arm opening 76 is sized to enclose a torsion spring 70 having a positioning pin at both ends, the first pin end inserted in a pin aperture 75 inside the aiming arm opening 76, the other positioning pin inserted in a pin aperture 74 on the body end 16*b*. When the aiming arm is rotated in one direction, a rotational force is generated by the torsion spring 80 in the opposite direction. The putter includes a drag washer 56 on the axle 50, frictionally contacting aiming arm 14*a* and the putter body end 16*a*. The drag washer dampens the rotational movement of aiming arm 14*a* so that the tension created by the torsion spring will affect a smooth rotational movement.

In another embodiment of the putter and control mechanism shown in FIGS. 7-10, downward pressure on the shaft provides the rotation energy for the aiming arms to rotate from the normal mode to the forward aiming position rather than the energy being supplied by manual rotation.

In an alternate embodiment of the putter, the rotation of the aiming arms may be achieved using a small electric motor in the putter body, activated by an electrical switch in the shaft.

Figure 8:
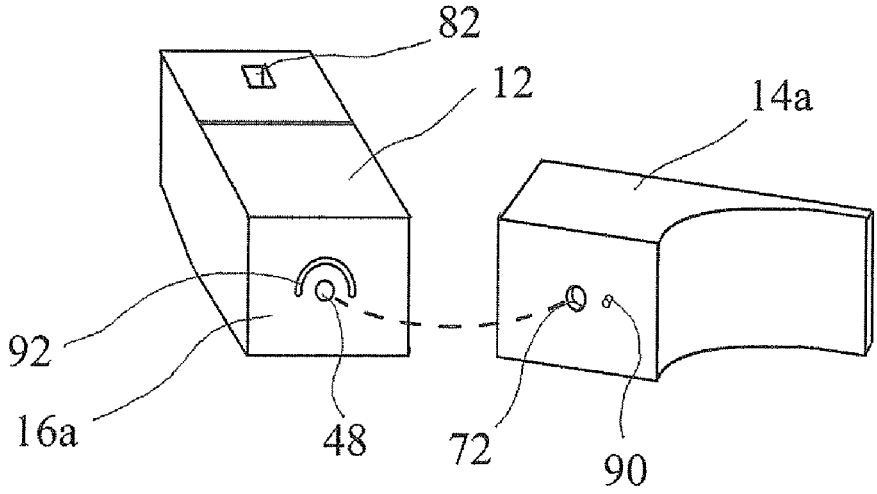
FIG. 8 is a perspective view of the mating ends of the body and the pivoting arm located away from the shaft.
Figure 9:
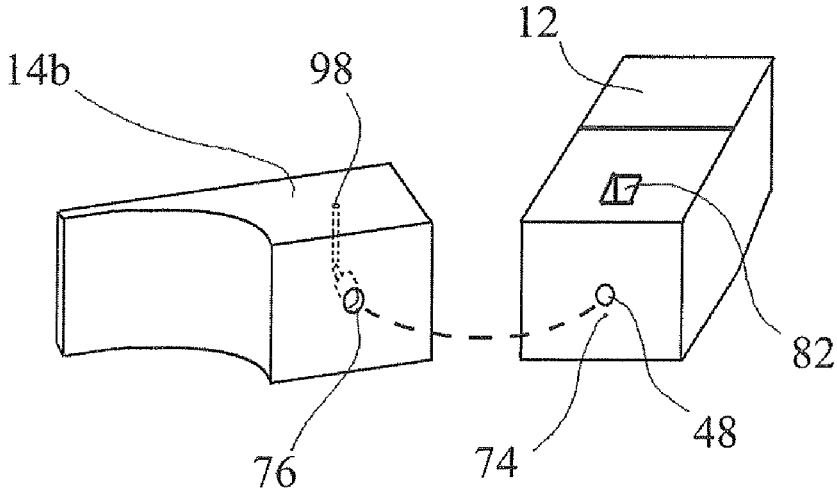
FIG. 9 is a perspective view of the mating ends of the body and the pivoting arm located near the shaft.
Figure 10:
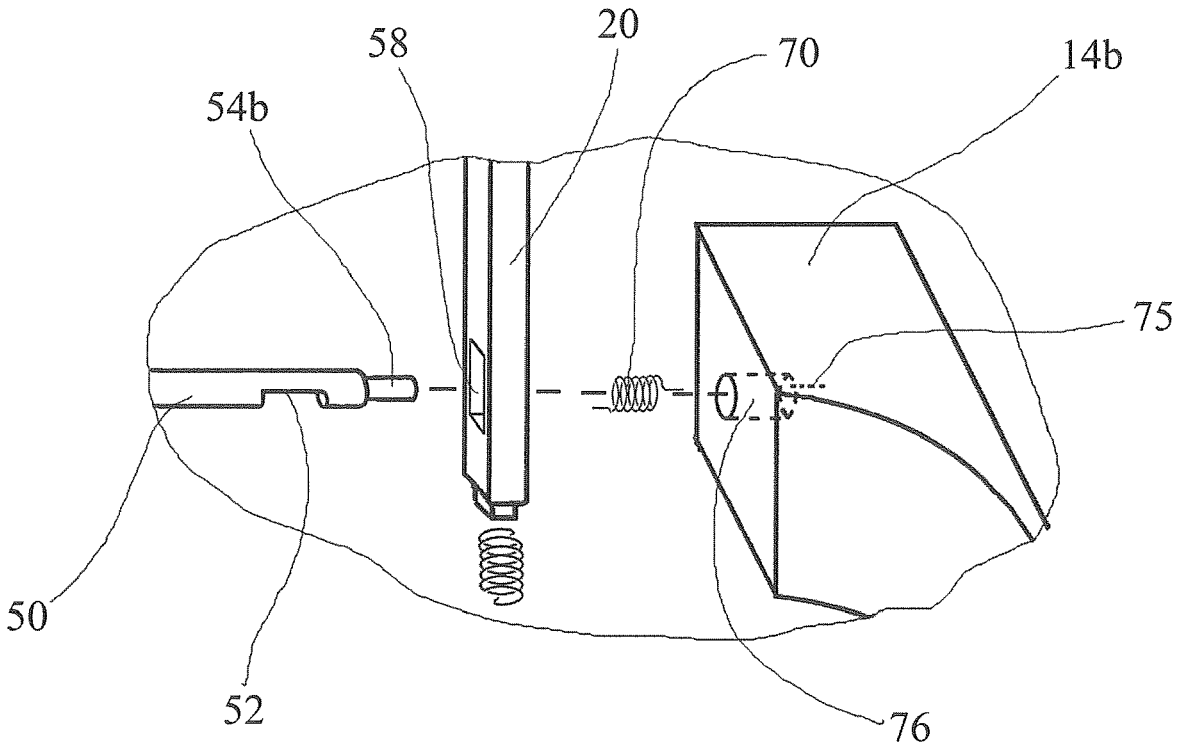
FIG. 10 is an enlarged view of the control mechanism shown in FIG. 7.

In assembling the putter described in the embodiment above, the shaft 20 is inserted into the shaft sleeve 82, the downward force on the shaft compressing the compression spring 80 and positioning the shaft slot 58 near the axle sleeve 48. The axle 50 is then slid into the axle sleeve 48 where a portion of the axle is positioned within the shaft slot 58. Releasing the downward pressure on the shaft allows the compression spring to urge the shaft upward until the lower end of the shaft slot seats on a portion of the axle groove 52. Each of the aiming arms is then fastened to the end of the axle protruding from the body. As shown in FIG. 8, at least one of the aiming arms includes a limit pin 90 which corresponds to a limit pin groove 92 on the body end. The limit pin allows the aiming arm 14*a*, 14*b* to move from the forward aiming position to the normal position in an upward arc. The limit pin does not allow the aiming arm to rotate in the reverse arc where the pointing member 24 would be forced into the ground.

Figure 11:
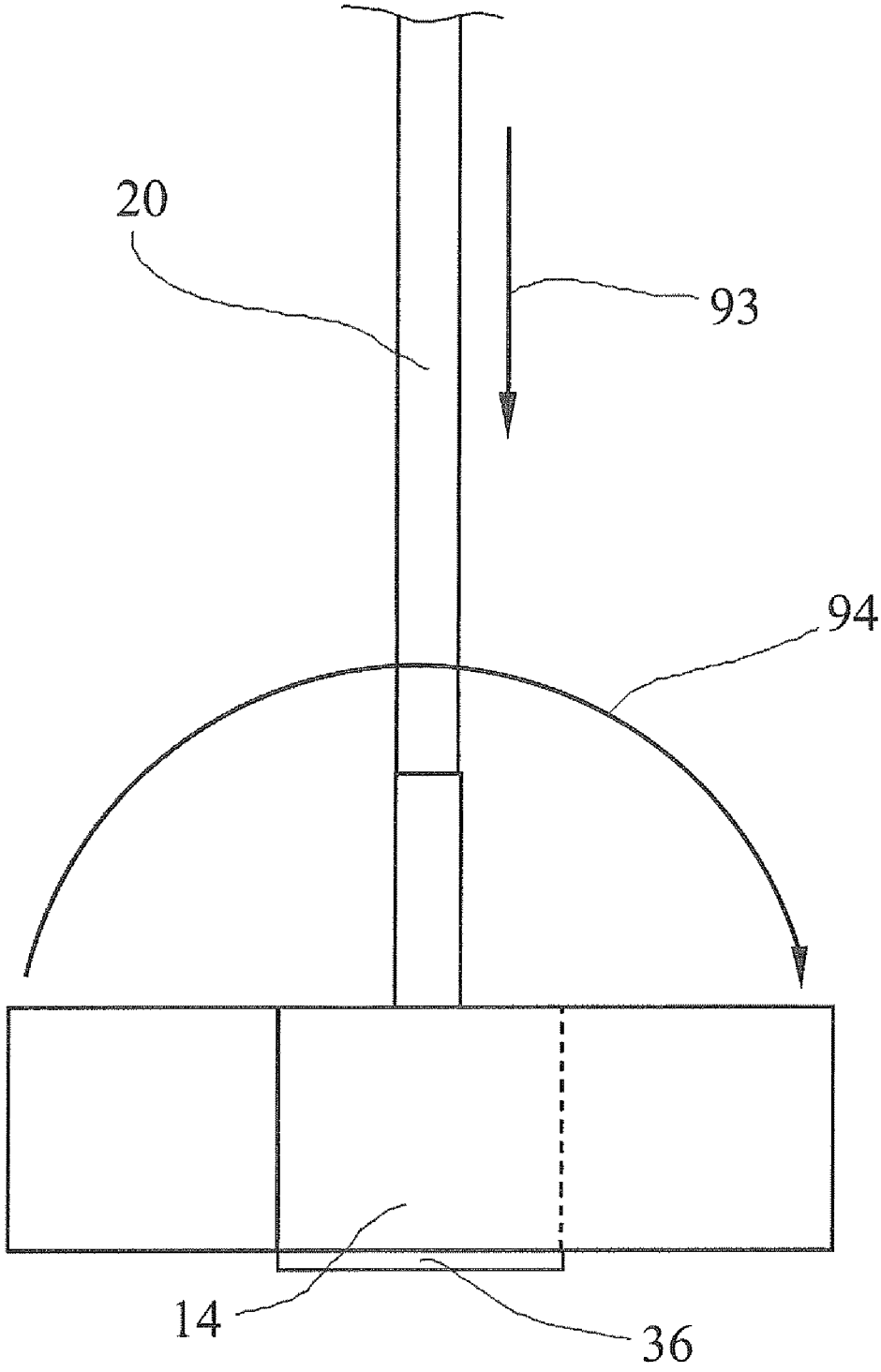
FIG. 11 is a side elevational view of the putter according to the present invention.

In a method for using the putter the golfer manually rotates the spring loaded aiming arms 14*a*, 14*b* to the forward aiming position. A flat portion of the axle groove 52 will then be in a position to allow the shaft 20 to engage the axle groove, the compression spring 80 urging the shaft upward and locking the aiming arms in the forward aiming position. The golfer may then, after lining up the putt, push downward on the shaft as shown in FIG. 11 along directional arrow 93, disengaging the shaft slot from the axle groove, releasing the axle 50 from its locked position. The aiming arms rotate upward and then rearward as shown by directional arrow 94, the rotational speed being governed by friction generated by the drag washer 56. The limiting pin 90 will prevent the aiming arms from rotating beyond the normal position.

In another embodiment of the putter, a lever will additionally control the rotation of the arms 14*a*, 14*b* between the rearward aiming position and the forward aiming position so that manual rotation of the aiming arms is not necessary.

Figure 4:
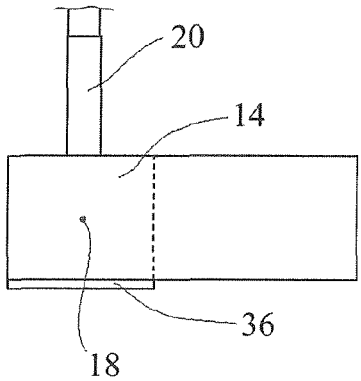
FIG. 4 is a side elevational view of the putter of FIG. 1

In a method of using the putter with pivoting aiming arms according to the present invention, FIGS. 1 and 4 show the preferred positions of the aiming arms 14*a*, 14*b* in each of the user modes. The golfer may use the aiming mode only for aligning the golf putt. Once the putt is aligned, the golfer rotates the aiming arms 14*a*, 14*b* to the normal, rearward-facing mode for striking the golf ball 99. In earlier stages of training, the golfer may choose to strike the ball while the aiming arms are in the aiming position, without using the putter in the normal mode. The putter according to the present invention allows the golfer to decide when he is ready for putting with the arms in the rearward aiming direction or in the second position.

In this arrangement the golfer continues to use the putter for practice, deciding how to use the aiming arms to his benefit, while being able to use the same putter he has been practicing with in regulation play.

In another embodiment of the method for using the putter shown in FIG. 1, the golfer ensures the aiming arms of the putter are in the aiming position and then approaches the ball 99. The "approach" is defined as the motions taken by a golfer to move toward the ball and take a stance in a direction to strike the ball toward the golf hole. The golfer then lines up the shot by visualizing the aiming arms extended in a straight line along the corresponding pointing member. The golfer then operates the lever such that the aiming arms rotate to the rearward aiming position and takes the shot.

In an alternate embodiment for using the putter, the golfer ensures the aiming arms 14*a*, 14*b* of the putter are in the aiming position, lines up the shot by visualizing the aiming arms extended in a straight line along the corresponding pointing member 24 and then takes the shot. In the preferred embodiment of the invention wherein the aiming arms 14*a*, 14*b* have an arcuate portion 26, 28, the golfer visualizes the arcuate portions of the aiming arms 26, 28 with the corresponding diameter of the golf hole cup while lining up his shot using aiming indicators 44*a*, 44*b* on the top surfaces of the aiming arms and visualization lines 62, 64, 66, 68. If the putt to be attempted requires a backswing distance or an amount of force which increases the chance the golf ball being struck off the center of the putter face, after lining up the shot and before taking the shot the golfer preferably operates the lever such that the aiming arms rotate to the normal mode rearward aiming position, decreasing his chances of hitting the ball with one of the arcuate surfaces 26, 28 on the aiming arms 14*a*, 14*b*.

In a method of training the golfer, the putter may be used solely in the aiming mode during initial stages of training. As the golfer progresses to a next training stage, the aiming arms are positioned in the normal mode just prior to taking the shot to allow the golfer to get used to putting in the normal mode. In a final stage of training or in regulation play, the putter may be maintained in the normal position. This method of training allows the progression of the golfer to be easily managed, from using the putter as a training aid to using the putter to play a regulation round of golf, all with the same putter.

Thus, the present invention achieves the objects described above. The invention provides a putter with a pair of aiming arms at opposite ends of the putter face which allow the golfer to set up a putt using the aiming arms, change the position of the aiming arms from a forward aiming position to a rearward aiming position, and then take the shot, all without having to bend over or lift the putter to change the position of the arms. This provides a higher level of practice since the golfer may gradually wean himself from using the forward aiming position as he becomes more comfortable using the rearward aiming position. The putter may be operated in this method for both practice and in regulation play, thus allowing the golfer the continuity of using the same club for both.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A golf putter head comprising:

an elongated body having a striking face and a central axis along a length thereof; and a pair of aiming arms, each arm having a pointing member and pivotally connected at opposing ends of the elongated body and adapted to pivot about the central axis between a forward aiming position wherein the pointing member extends beyond the striking face and a second position away from the forward aiming position, the aiming arms having a rotational preload force when the arms are in the forward aiming position; and a rotation control mechanism adapted to release the aiming arms and control rotation of the aiming arms from the forward aiming position to the second position.

2. The golf putter head of claim 1 including a drag washer between at least one of the aiming arms and the elongated body wherein the drag washer applies a dampening force on the aiming arm when the aiming arm is released to rotate to the second position.

3. The golf putter head of claim 1 wherein the elongated body includes a top surface adjacent a face surface and wherein the top surface has a center aiming line.

4. The golf putter head according to claim 1 wherein the control mechanism is adapted to rotate the aiming arms from the forward aiming position to the second position and to rotate the aiming arms from the second position to the forward aiming position.

5. The golf putter head of claim 1 including parallel aiming indicators positioned on the aiming arms wherein the distance between the aiming lines corresponds with the diameter of a regulation golf hole cup.

6. A golf putter head comprising:

an elongated body having a striking face and a central axis along a length thereof;

a pair of aiming arms, each arm having a pointing member and pivotally connected at opposing ends of the elongated body and adapted to pivot about the central axis between a forward aiming position wherein the pointing member extends beyond the striking face and a second position away from the forward aiming position; and a spring adapted for exerting a rotational force on the aiming arms in a direction toward the second position.

7. A golf putter head comprising:

an elongated body having a striking face and a central axis along a length thereof;

a pair of aiming arms, each arm having a pointing member and pivotally connected at opposing ends of the elongated body and adapted to pivot about the central axis between a forward aiming position wherein the pointing member extends beyond the striking face and a second position away from the forward aiming position;

a rotation control mechanism adapted to control rotation of the aiming arms from the forward aiming position to the second position; and a spring adapted for exerting a rotational force on the aiming arms in a direction toward the second position.

8. The golf putter head of claim 7 wherein the control mechanism releases the aiming arms from the forward aiming position to the second position.

9. A golf putter head comprising:

an elongated body having a striking face and a central axis along a length thereof; and a pair of aiming arms, each arm having a pointing member and pivotally connected at opposing ends of the elongated body and adapted to pivot about the central axis between a forward aiming position wherein the pointing member extends beyond the striking face and a second position away from the forward aiming position, the aiming arms having opposite and inward facing arcuate surfaces corresponding to the outline of a golf hole cup, the pointing members having a spacing corresponding to the diameter of a regulation golf hole cup.

10. A golf putter comprising:

a shaft;

a putter head attached along a top surface to the shaft, the head including an elongated body having a central axis along a length thereof; and a pair of aiming arms, each arm pivotally connected at opposing ends of the elongated body and adapted to pivot about the central axis between a forward aiming position and a second position away from the forward aiming position;

wherein the shaft is adapted to control rotation of the aiming arms from the forward aiming position to the second position.

11. The golf putter of claim 10 including:

an axle having ends and an axle groove between the ends positioned along the central axis of the putter body, the aiming arms attached at the ends of the axle;

a torsion spring fastened to the putter body and to at least one aiming arm wherein the torsion spring applies a rotational force on the aiming arm;

a shaft sleeve in the putter head extending downward from the top surface to a shaft sleeve bottom wherein the shaft is slidingly positioned in the shaft sleeve and is in contact with a portion of the axle;

a compression spring seated at the bottom of the shaft sleeve, the compression spring urging the shaft in an upward direction;

a shaft slot positioned at the lower end of the shaft in contact with a portion of the axle groove;

wherein the axle groove engages the shaft, locking the aiming arms in the forward aiming position, and;

wherein urging the shaft downward disengages the shaft slot from axle groove, allowing the torsion spring to rotate the aiming arms from the forward aiming position to the second position.

* * * * *